US011233380B2

(12) United States Patent
Kuhnert

(10) Patent No.: US 11,233,380 B2
(45) Date of Patent: Jan. 25, 2022

(54) PRECHAMBER SPARK PLUG

(71) Applicant: DKT VERWALTUNGS-GMBH, Sinsheim (DE)

(72) Inventor: Steffen Kuhnert, Heidelberg (DE)

(73) Assignee: DKT VERWALTUNGS-GMBH, Walldorf (DE)

( * ) Notice: Subject to any disclaimer, the term of this patent is extended or adjusted under 35 U.S.C. 154(b) by 87 days.

(21) Appl. No.: 16/491,924

(22) PCT Filed: Dec. 18, 2017

(86) PCT No.: PCT/DE2017/200135
§ 371 (c)(1),
(2) Date: Sep. 6, 2019

(87) PCT Pub. No.: WO2018/166549
PCT Pub. Date: Sep. 20, 2018

(65) Prior Publication Data

US 2021/0135433 A1 May 6, 2021

(30) Foreign Application Priority Data

Mar. 14, 2017 (DE) ..... 102017204241.9

(51) Int. Cl.
*H01T 13/54* (2006.01)

(52) U.S. Cl.
CPC ..... *H01T 13/54* (2013.01)

(58) Field of Classification Search
CPC ..... H01T 13/54
USPC ..... 313/143
See application file for complete search history.

(56) References Cited

U.S. PATENT DOCUMENTS

2005/0000484 A1 1/2005 Schultz et al.
2013/0206122 A1* 8/2013 Chiera ..... F02P 15/001 123/594
2014/0102404 A1* 4/2014 Sotiropoulou ..... F02B 19/18 123/260
2014/0165980 A1* 6/2014 Chiera ..... H01T 13/467 123/704
2016/0326946 A1* 11/2016 Willi ..... F02B 19/08
2017/0145898 A1* 5/2017 Schafer ..... H01T 13/467
2018/0313256 A1* 11/2018 Dumser ..... F02B 19/12

FOREIGN PATENT DOCUMENTS

DE 2715943 A1 10/1978
DE 3145119 A1 5/1983
DE 102004024839 A1 1/2005
EP 0675272 A1 10/1995
(Continued)

OTHER PUBLICATIONS

International Search Report for Application No. PCT/DE2017/200135, dated Mar. 28, 2018.
(Continued)

*Primary Examiner* — Christopher M Raabe
(74) *Attorney, Agent, or Firm* — Jeremy R. Kriegel

(57) ABSTRACT

A pre-chamber spark plug includes a housing, a ground electrode, and a pre-chamber defined by the housing and a cap, a center electrode being arranged within the pre-chamber, in which the V/D ratio of the pre-chamber volume V to the largest internal diameter D of the pre-chamber (5) is in the range of from 30 mm2 to 95 mm2.

10 Claims, 3 Drawing Sheets

(56) References Cited

FOREIGN PATENT DOCUMENTS

| | | | |
|---|---|---|---|
| EP | 1984993 | A1 | 10/2008 |
| JP | 2005090381 | A | 4/2005 |
| WO | WO-2004/036013 | A1 | 4/2004 |
| WO | WO-2007/092972 | A1 | 8/2007 |
| WO | WO-2012/091739 | A2 | 7/2012 |

OTHER PUBLICATIONS

International Preliminary Report on Patentability and Written Opinion of the International Searching Authority for Application No. PCT/DE2017/200135, dated Sep. 17, 2019.
"*Taschenbuch der Mathematik* ". Bronstein-Semendjajew-Musiol-Muhlig, Verlag Harri Deutsch, 4th Edition 1999, p. 150.
Notice of Opposition for Application No. 17842286.1, dated Oct. 20, 2021.

* cited by examiner

PRECHAMBER SPARK PLUG

CROSS-REFERENCE TO RELATED APPLICATION

This present application is the US national phase of International Patent Application No. PCT/DE2017/200135, filed Dec. 18, 2017, which claims priority to German Application No. 102017204241.9, filed Mar. 14, 2017. The priority application, DE 102017204241.9, is hereby incorporated by reference in its entirety.

BACKGROUND

The present invention relates to a pre-chamber spark plug comprising a housing, a ground electrode, and a pre-chamber defined by the housing and a cap, a center electrode being arranged within the pre-chamber.

Pre-chamber spark plugs of the type in question have been known for many years from practice. For example, pre-chamber spark plugs are used in internal combustion engines operating on the lean burn principle. Pre-chamber spark plugs have a pre-chamber which interacts with the combustion chamber of an internal combustion engine by means of transfer openings. The fuel-air mixture is ignited by means of ignition sparks in the pre-chamber, after which the combustion in the form of ignition flares continues through the transfer openings into the combustion chamber of the internal combustion engine where it ignites the mixture.

A pre-chamber spark plug is known, for example, from WO 2007/092972 A1. This spark plug comprises a pre-chamber provided with a pre-chamber wall and a cover surface. The pre-chamber wall comprises a cylindrical part to which rectangular ground electrodes are likewise fastened by means of rectangular ground electrode supports. Rectangular ignition electrodes, which are fastened to a central ignition electrode support, are assigned to the ground electrodes. This produces a plurality of pairs of ignition surfaces, with which ignition that is as central as possible relative to the pre-chamber is intended to be carried out.

The known pre-chamber spark plugs have the disadvantage that relatively high wall heat losses occur. Another disadvantage is the insufficient flame propagation, which results in a low level of efficiency of the pre-chamber spark plug.

The problem addressed by the present invention is therefore to design and develop a pre-chamber spark plug of the type mentioned at the outset such that the function of the pre-chamber spark plug is improved using structurally simple means.

SUMMARY OF THE DISCLOSURE

According to the invention, in the pre-chamber spark plug in question, the V/D ratio of the pre-chamber volume V to the largest internal diameter D of the pre-chamber is in the range of from 30 $mm^2$ to 95 $mm^2$.

The invention is based on the finding that the layout of the pre-chamber has significant effects on the functionality of the pre-chamber spark plug. In particular, it has been identified that a sufficiently spherical design of the pre-chamber requires optimum flame propagation and reduced wall heat losses. To solve the problem addressed, the V/D ratio between the pre-chamber volume V enclosed by the pre-chamber and the largest internal diameter D of the pre-chamber is therefore optimized, namely in the range of from 30 $mm^2$ to 95 $mm^2$. With such a V/D ratio, the functionality of the pre-chamber spark plug is optimized in an ideal manner.

It should be noted at this point that the term "pre-chamber volume" is understood to mean the volume of the pre-chamber enclosed by the inner wall of the housing and the cap or the electrodes, without the overflow holes or transfer passages.

Advantageously, the V/D ratio of the pre-chamber volume V to the largest internal diameter D of the pre-chamber is in the range of from 35 $mm^2$ to 90 $mm^2$. In a particularly advantageous manner, the V/D ratio is in the range of from 40 $mm^2$ to 70 $mm^2$, whereby optimal functionality of the pre-chamber is achieved, namely wall heat losses are minimized and flame propagation is optimized.

To further improve the ignition properties, at least one corner and/or edge formed on the inside of the pre-chamber may be rounded. In particular, it is conceivable that all of the corners and/or edges formed on the inside of the pre-chamber are rounded. The rounded design prevents hot spots in the pre-chamber. This has the advantage that the fuel-air mixture is prevented from igniting in an uncontrolled manner on a hot surface of this kind as far as possible.

In a more advantageous manner, it is conceivable that the rounded corner or corners define a radius RE of greater than or equal to 0.4 mm, i.e. $R \geq 0.4$ mm and/or an angle $\beta$ in the range of greater than or equal to 90°.

Alternatively or additionally, at least one of the edges formed on the inside of the pre-chamber may have an angle $\beta'$ in the range of from greater than or equal to 90° to less than 100° and/or may have a radius RK of greater than or equal to 0.8 mm, i.e. $90° \leq \beta' < 100°$ and $RK \geq 0.8$ mm. In a particularly advantageous manner, the angle $\beta'$ is in the range of from greater than or equal to 100° to less than 120° and/or the radius RK is in a range of greater than or equal to 0.6 mm, i.e. $100° \leq \beta < 120°$ and $RK \geq 0.6$ mm.

In a more advantageous manner, the radius RK may be in a range of greater than or equal to 0.4 mm and/or the angle $\beta'$ may be greater than or equal to 120°, i.e. $\beta' \geq 120°$ and $R \geq 0.4$ mm.

In order to minimize the heat input into the spark plug via the cap surface projecting into the combustion chamber, the y/Da ratio between the protrusion measurement y and the largest external diameter Da of the cap may be in the range of 0.2 to 1.0. The protrusion measurement y is defined as the length of the region of the pre-chamber spark plug that projects beyond the combustion chamber roof into the combustion chamber.

To protect the weld seam connecting the cap to the housing, the weld seam can be at the same height as or above the combustion chamber roof when the pre-chamber spark plug is arranged in the combustion chamber roof. This ensures that the weld seam is not subject to excessive erosion due to contact with the gases and flames in the combustion chamber.

It should be noted that the present invention also comprises a kit consisting of a combustion chamber roof and a pre-chamber spark plug comprising a housing, a ground electrode and a pre-chamber defined by the housing and a cap, a center electrode being arranged within the pre-chamber and, when the pre-chamber spark plug is arranged in a combustion chamber roof, the y/Da ratio between the protrusion measurement y and the largest external diameter Da of the cap being in the range of from 0.2 to 1.0 and/or the weld seam connecting the cap to the housing being at the same height as or above the combustion chamber roof.

Furthermore, the pre-chamber spark plug in the kit may have one or more features of claims 1 to 10 and of the following description of the figures.

The present invention also relates to a pre-chamber spark plug comprising a housing, a ground electrode and a pre-chamber defined by the housing and a cap, a center electrode being arranged within the pre-chamber and, when the pre-chamber spark plug is arranged in a combustion chamber roof, the $y/D_a$ ratio between the protrusion measurement y and the largest external diameter $D_a$ of the cap being in the range of from 0.2 to 1.0 and/or the weld seam connecting the cap to the housing being at the same height as or above the combustion chamber roof. A spark plug of this kind may have one or more of the following description of the figures.

Furthermore, the present invention relates to a pre-chamber spark plug comprising a housing, a ground electrode, and a pre-chamber defined by the housing and a cap, a center electrode being arranged within the pre-chamber, wherein at least one corner and/or edge formed on the inside of the pre-chamber is rounded. A pre-chamber spark plug of this kind may furthermore have one or more of the following description of the figures.

There are now various possibilities for designing and developing the teaching of the present invention in an advantageous manner. For this purpose, reference is made to the following explanation of preferred embodiments of the invention with reference to the drawings. In conjunction with the explanation of the preferred embodiments of the invention with reference to the drawings, generally preferred embodiments and developments of the teaching are also explained. In the drawings:

DETAILED DESCRIPTION OF THE PREFERRED EMBODIMENT

Figure 1:
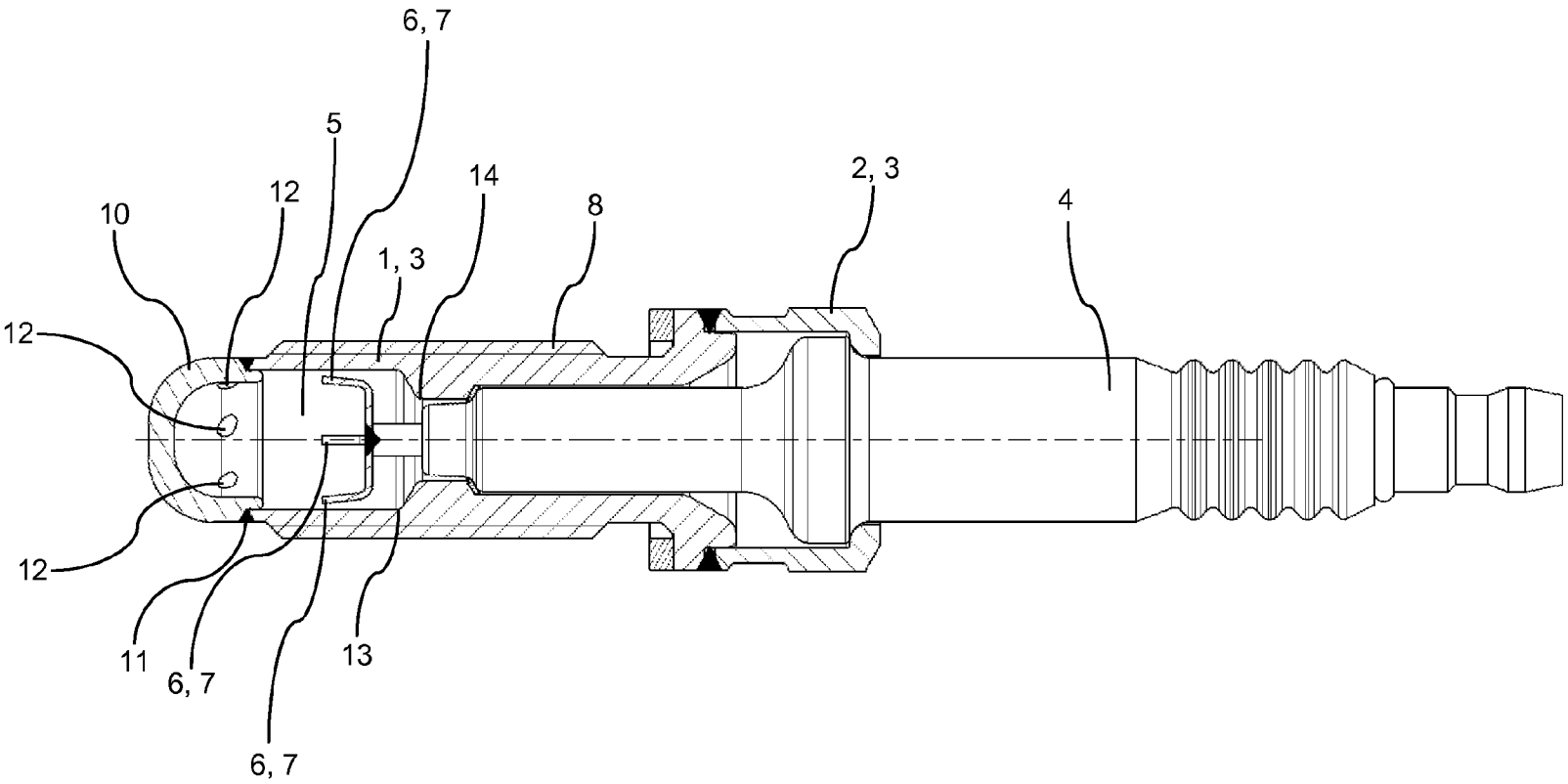
FIG. 1 is a schematic view of an embodiment of a pre-chamber spark plug according to the invention.
Figure 2:
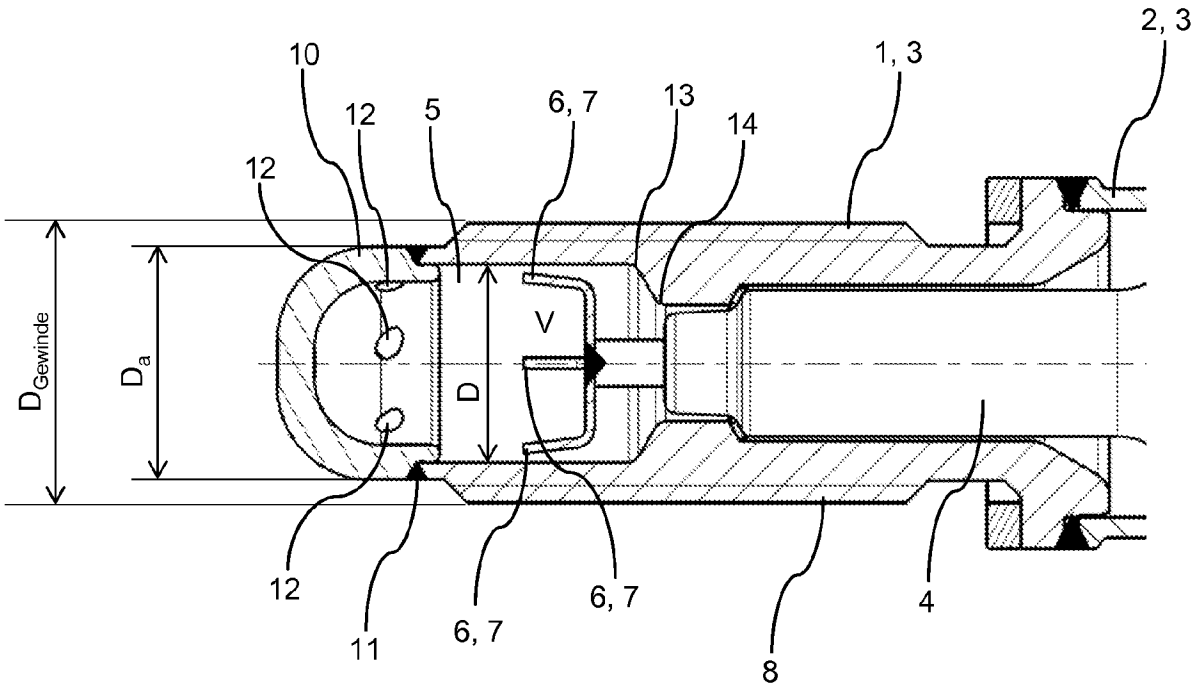
FIG. 2 is an enlarged view of a detail from FIG. 1.
Figure 3:
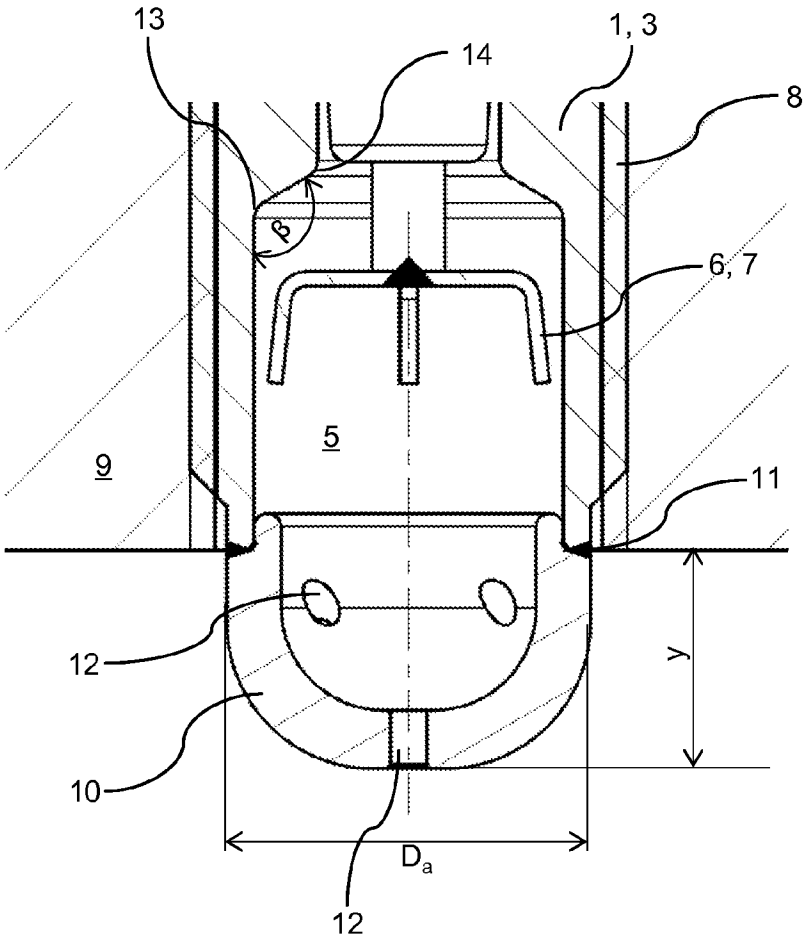
FIG. 3 is a schematic view of the pre-chamber spark plug according to the invention according to FIG. 1 when arranged in a combustion chamber roof.

FIGS. 1 to 3 are schematic views of an embodiment of a pre-chamber spark plug according to the invention. The pre-chamber spark plug comprises a housing 3 formed by a first housing part 1 and a second housing part 2. The housing parts 1, 2 are interconnected by a weld seam. The housing 1 surrounds a part of an insulator 4. A supply line (not shown) which supplies the center electrode 6 provided within the pre-chamber 5 with electrical voltage is arranged within the insulator 4. The center electrode 6 comprises a total of four electrode arms 7. The center electrode 6 may also have a different geometry, however. Furthermore, it should be noted that the housing 3 may also be formed in one piece.

In the embodiment shown here, the first housing part 1 serves as a ground electrode and has an external thread 8 in order to fix the pre-chamber spark plug in a housing cover which defines the combustion chamber roof 9, as shown in FIG. 3. The pre-chamber 5 is closed by the cap 10 in the direction of the main combustion chamber. The cap 10 is connected to the first housing part 1 by a weld seam 11. It is conceivable for the cap 10 to extend as far as the center electrode 6 and to serve as a ground electrode. The cap 10 comprises a plurality of transfer passages 12, which may be arranged around the cap 10 in the circumferential direction.

FIG. 2 shows the largest internal diameter D of the pre-chamber 5. It is essential here that the ratio of the pre-chamber volume V to the largest internal diameter D of the pre-chamber is in the range of from 30 $mm^2$ to 95 $mm^2$, in particular in the range of from 35 $mm^2$ to 90 $mm^2$, preferably in the range of from 40 $mm^2$ to 70 $mm^2$.

In addition, FIGS. 2 and 3 show the largest external diameter Da of the cap 10. Furthermore, the protrusion measurement y of the pre-chamber spark plug arranged in the combustion chamber roof 9 is clear from FIG. 3. Advantageously, the y/Da ratio between the protrusion measurement y and the largest external diameter Da of the cap 5 is in the range of 0.2 to 1.0.

FIG. 3 also shows that the weld seam 11 which connects the cap 10 to the first housing part 1 is at the same height as the combustion chamber roof 9. Alternatively, it is conceivable for the weld seam 11 to be arranged above the combustion chamber roof 9, such that only a part of the cap 10 projects into the combustion chamber.

Furthermore, it can be seen in FIG. 3 that the corners 13 and edges 14 produced on the inside of the pre-chamber 5 are rounded. Specifically, the corners 13 may have a radius RE of greater than or equal to 0.4 mm and/or may have an angle β of greater than or equal to 90°. In the embodiment shown here, the angle β measures approximately 120°. An angle of greater than 90° has the advantage that the radius can be made smaller, so that less reworking is necessary. The angle β' formed by the edges 14 may be in the range of from greater than or equal to 90° to less than 100° and/or the edges 14 may have a radius RK of greater than or equal to 0.8 mm. Furthermore, it is conceivable for the angle β' to be in the range of from greater than or equal to 100° to less than 120° and/or for the edges 14 to have a radius RK of greater than or equal to 0.6 mm. According to another embodiment, the edges may have a radius RK of greater than or equal to 0.4 mm and/or the angle β' may be in the range of greater than or equal to 120°. The angles β and β' may be formed as alternate angles.

With regard to further advantageous embodiments of the device according to the invention, reference is made to the general part of the description and to the appended claims in order to avoid repetition.

Finally, it should be expressly noted that the above-described embodiments of the device according to the invention are merely used for the purpose of discussing the claimed teaching, but this is not limited to the embodiments.

The invention claimed is:

1. A pre-chamber spark plug comprising a housing, a ground electrode, and a pre-chamber defined by the housing and a cap, a center electrode being arranged within the pre-chamber, the V/D ratio of the pre-chamber volume V to the largest internal diameter D of the pre-chamber being in a range of 30 $mm^2$ to 95 $mm^2$, the largest internal diameter D being defined by the housing and the internal diameter of the cap narrowing down towards the end of the pre-chamber.

2. The pre-chamber spark plug according to claim 1, the V/D ratio of the pre-chamber volume V to the largest internal diameter D of the pre-chamber is in a range of 35 $mm^2$ to 90 $mm^2$.

3. The pre-chamber spark plug according to claim 1, and at least one corner and/or edge formed on the inside of the pre-chamber is rounded.

4. The pre-chamber spark plug according to claim 1, and all of the corners and/or edges formed on the inside of the pre-chamber are rounded.

5. The pre-chamber spark plug according to claim 3, and the corner or corners have a radius RE of greater than or equal to 0.4 mm and/or have an angle β greater than or equal to 90°.

6. The pre-chamber spark plug according to claim 1, and at least one of the edges formed on the inside of the pre-chamber has an angle β' in a range of greater than or equal to 90° to less than 100° and/or has a radius RK of greater than or equal to 0.8 mm.

7. The pre-chamber spark plug according to claim 1, and at least one of the edges formed on the inside of the pre-chamber has an angle β' in a range of greater than or equal to 100° to less than 120° and/or has a radius RK of greater than or equal to 0.6 mm.

8. The pre-chamber spark plug according to claim 1, and at least one of the edges formed on the inside of the pre-chamber has an angle β' in a range of greater than or equal to 120° and/or has a radius RK of greater than or equal to 0.4 mm.

9. The pre-chamber spark plug according to claim 1, when arranged in a combustion chamber roof, the y/Da ratio between the protrusion measurement y and the largest external diameter Da of the cap is in a range of 0.2 to 1.0.

10. The pre-chamber spark plug according to claim 1, when arranged in a combustion chamber roof, the weld seam connecting the cap to the housing is at the same height as or above the combustion chamber roof.

* * * * *